US009290898B2

(12) United States Patent
Abramczyk et al.

(10) Patent No.: US 9,290,898 B2
(45) Date of Patent: Mar. 22, 2016

(54) PLOW BLADE DAMPING DEVICE AND METHOD

(71) Applicant: Ironhawk Industrial Distribution LLC, Beachwood, OH (US)

(72) Inventors: Ron Abramczyk, Willowick, OH (US); Eric Fox, Sligo, PA (US)

(73) Assignee: Ironhawk Industrial Distribution LLC, Euclid, OH (US)

( * ) Notice: Subject to any disclaimer, the term of this patent is extended or adjusted under 35 U.S.C. 154(b) by 0 days.

(21) Appl. No.: 13/769,517

(22) Filed: Feb. 18, 2013

(65) Prior Publication Data

US 2013/0212915 A1 Aug. 22, 2013

Related U.S. Application Data

(60) Provisional application No. 61/600,833, filed on Feb. 20, 2012.

(51) Int. Cl.
*E01H 5/06* (2006.01)

(52) U.S. Cl.
CPC ..... *E01H 5/062* (2013.01); *E01H 5/061* (2013.01); *Y10T 29/49844* (2015.01)

(58) Field of Classification Search
USPC ..... 37/232, 266, 270, 407
IPC ..... E01H 5/061,5/062
See application file for complete search history.

(56) References Cited

U.S. PATENT DOCUMENTS 2,061,585 A 11/1936 Meyer
3,198,565 A 8/1965 Ellis
3,408,086 A 10/1968 Bennett
3,413,738 A * 12/1968 Goldberg ..... 37/233
3,465,456 A * 9/1969 Meyer ..... 37/233
3,477,149 A 11/1969 Wagner
4,178,012 A 12/1979 Roth et al.
4,288,932 A 9/1981 Küper
4,347,677 A 9/1982 Kuper
4,431,209 A 2/1984 Volkl et al.
4,571,860 A 2/1986 Long (Continued)

FOREIGN PATENT DOCUMENTS

CN 202787166 U 3/2013
DE 2403051 A1 8/1974

(Continued)

OTHER PUBLICATIONS

Statement Regarding Potential Prior Art Submitted Nov. 18, 2014.

*Primary Examiner* — Gary Hartmann
(74) *Attorney, Agent, or Firm* — Calfee, Halter & Griswold LLP

(57) ABSTRACT

The present application discloses a damping member that can be used during mounting of a plow blade edge to a moldboard. In one exemplary embodiment, a plow blade comprises a plow blade edge, a damping member, and at least one fastener. The plow blade edge has at least one aperture extending therethrough for mounting the plow blade to the moldboard. The damping member is positioned between the plow blade edge and the moldboard such that no portion of the plow blade edge contacts the moldboard when the plow blade is mounted to the moldboard. The at least one fastener extends through the at least one aperture of the plow blade edge and at least one aperture of the damping member to mount the plow blade to the moldboard.

32 Claims, 8 Drawing Sheets

(56) References Cited

U.S. PATENT DOCUMENTS

| | | | | |
|---|---|---|---|---|
| 4,590,694 | A | 5/1986 | Block | |
| 4,667,943 | A * | 5/1987 | Izumi et al. | 267/141.3 |
| 5,471,770 | A | 12/1995 | Ferreira | |
| 5,743,032 | A * | 4/1998 | Vauhkonen | 37/446 |
| 5,746,017 | A | 5/1998 | Marvik | |
| 6,751,894 | B2 * | 6/2004 | Verseef | 37/266 |
| 6,922,924 | B2 | 8/2005 | Jones et al. | |
| 7,107,709 | B2 * | 9/2006 | Hamel | 37/232 |
| 7,467,485 | B2 | 12/2008 | Lachance et al. | |
| 7,584,557 | B1 | 9/2009 | Nistler | |
| 7,631,441 | B2 | 12/2009 | Hunt | |
| 7,765,726 | B2 | 8/2010 | Kuper | |
| 7,874,085 | B1 | 1/2011 | Winter et al. | |
| 7,905,035 | B2 | 3/2011 | Thomas | |
| 8,191,287 | B2 * | 6/2012 | Winter et al. | 37/266 |
| 8,984,778 | B2 * | 3/2015 | Fox et al. | 37/266 |
| 2004/0006894 | A1 | 1/2004 | Schultz et al. | |
| 2004/0006895 | A1 | 1/2004 | Schultz et al. | |
| 2004/0060201 | A1 | 4/2004 | Schultz et al. | |
| 2008/0052929 | A1 | 3/2008 | Paonessa | |
| 2009/0307934 | A1 | 12/2009 | Wendorff et al. | |
| 2011/0287203 | A1 | 11/2011 | Victor et al. | |
| 2011/0287223 | A1 | 11/2011 | Victor et al. | |
| 2011/0311769 | A1 | 12/2011 | Chen et al. | |
| 2012/0260537 | A1 * | 10/2012 | Winter et al. | 37/270 |
| 2013/0161152 | A1 | 6/2013 | Wing | |
| 2013/0174452 | A1 * | 7/2013 | Diehl et al. | 37/233 |

FOREIGN PATENT DOCUMENTS

| | | |
|---|---|---|
| DE | 2400440 | 7/1975 |
| DE | 3319223 | 7/1984 |
| DE | 3404030 | 7/1985 |
| DE | 3814240 | 11/1989 |
| DE | 19643847 | 5/1998 |
| DE | 102005040705 | 3/2007 |
| EP | 1731676 | 12/2006 |
| KR | 101317693 B1 | 10/2013 |
| SE | 454279 | 4/1988 |
| WO | 2005124031 | 12/2005 |
| WO | 2007131663 | 11/2007 |

* cited by examiner

PLOW BLADE DAMPING DEVICE AND METHOD

CROSS REFERENCE TO RELATED APPLICATION

This application is a U.S. Non-Provisional Patent Application which claims priority to U.S. Provisional Patent Application No. 61/600,833, filed on Feb. 20, 2012 and titled "Plow Blade Damping Device and Method," which is hereby incorporated by reference in its entirety.

BACKGROUND

Plowing vehicles, such as snowplowing vehicles, generally have a curved, shovel like device commonly known as a moldboard disposed on the front, side underneath, and/or rear of the vehicle. A plow blade is generally removably attached to a lower portion of the moldboard. The plow blade acts as the cutting edge by scraping along the upper surface of a roadway to remove snow or other materials from the roadway. As such, the plow blade often wears quickly and requires replacement. Further, certain segments of the plow blade may wear more quickly than others due to various factors beyond the control of a plow vehicle operator such as uneven or crowned roadways or the plow blade striking objects in or on the roadway.

The entire plowing system, including the plow blade experiences various shocks and vibrations during use that contribute to the wear and damage of the plow blade and other components and generally decrease their useful life. The plow blade may also develop stress fractures due to the various forces applied to the plow blade during use and/or the weight of the moldboard itself. Still further, the noise, shock, and vibrations generated when the plow blade scrapes against the roadway often reverberate through the plowing system, including the moldboard and the plowing vehicle, thereby affecting the driver of the vehicle and/or potentially affecting other components of the vehicle (e.g., loosening or damaging other components of the vehicle).

SUMMARY

The present application discloses a damping member that can be used during mounting of a plow blade edge to a moldboard. Methods of installing such a damping member onto a plow blade and a moldboard are also disclosed.

For example, in one exemplary embodiment, a plow blade for mounting to a plow moldboard is disclosed. The plow blade comprises a plow blade edge, a damping member, and at least one fastener. The plow blade edge has at least one aperture extending therethrough for mounting the plow blade to the moldboard. The damping member is positioned between the plow blade edge and the moldboard such that no portion of the plow blade edge contacts the moldboard when the plow blade is mounted to the moldboard. The damping member has at least one aperture extending therethrough that is substantially aligned with the at least one aperture of the plow blade edge when the plow blade is mounted to the moldboard. Further, the at least one fastener extends through the at least one aperture of the plow blade edge and the at least one aperture of the damping member to mount the plow blade to the moldboard.

In another exemplary embodiment, a method of installing a plow blade to a plow moldboard is disclosed. The method includes utilizing a damping member having at least one projection extending from a first longitudinal surface of the damping member and at least one aperture extending through the damping member from the first longitudinal surface to a second longitudinal surface and through the at least one projection. The method also includes utilizing a plow blade edge having a longitudinal surface and at least one aperture. The at least one projection of the damping member is aligned with the at least one aperture in a plow blade edge. The first longitudinal surface of the damping member is positioned against the longitudinal surface of the plow blade edge and the second longitudinal surface of the damping member is positioned against a plow moldboard. The at least one aperture of the damping member is aligned with at least one aperture in the plow moldboard. A fastener is inserted through the at least one aperture of the damping member and the at least one aperture in the plow moldboard to mount the plow blade edge and the damping member to the moldboard.

In another exemplary embodiment, a plow comprising a moldboard and a plow blade is disclosed. The plow blade is removably attached to the moldboard and comprises a plow blade edge, a damping member, and at least one fastener. The plow blade edge has at least one aperture extending therethrough. The damping member has at least one aperture extending therethrough and at least one projection surrounding the at least one aperture. The at least one projection extends from a longitudinal surface of the damping member and is received in the at least one aperture of the plow blade edge. The damping member is positioned between the plow blade edge and the moldboard such that no portion of the surface of the plow blade edge contacts the moldboard when the plow blade is attached to the moldboard. The at least one fastener extends through the at least one aperture of the damping member and the at least one aperture in the moldboard to attach the plow blade to the moldboard.

In another exemplary embodiment, a damping device suitable for installation between a plow blade edge having multiple apertures and a plow moldboard having multiple apertures to dampen vibrations between the plow blade edge and the plow moldboard is disclosed. The damping device comprises an elongated strip having a plurality of apertures that are designed to align with the pre-existing apertures of the plow blade edge and the plow moldboard. The elongated strip may comprise one or more smooth surfaces or non-smooth surfaces with surface features. The elongated strip has a length substantially similar to that of the plow blade edge and the lower edge of plow moldboard such that, upon installation of the damping device between the plow blade edge and the plow moldboard, no surface of the plow blade edge contacts any surface of the plow moldboard.

DESCRIPTION OF EMBODIMENTS

The present application discloses a noise, shock, and vibration damping member or isolator used to mount a plow blade edge to a moldboard. The present application also discloses a plow and a plow blade comprising a damping member of the present application. Methods of installing a plow blade and a damping member on a moldboard are also disclosed.

Figure 1:
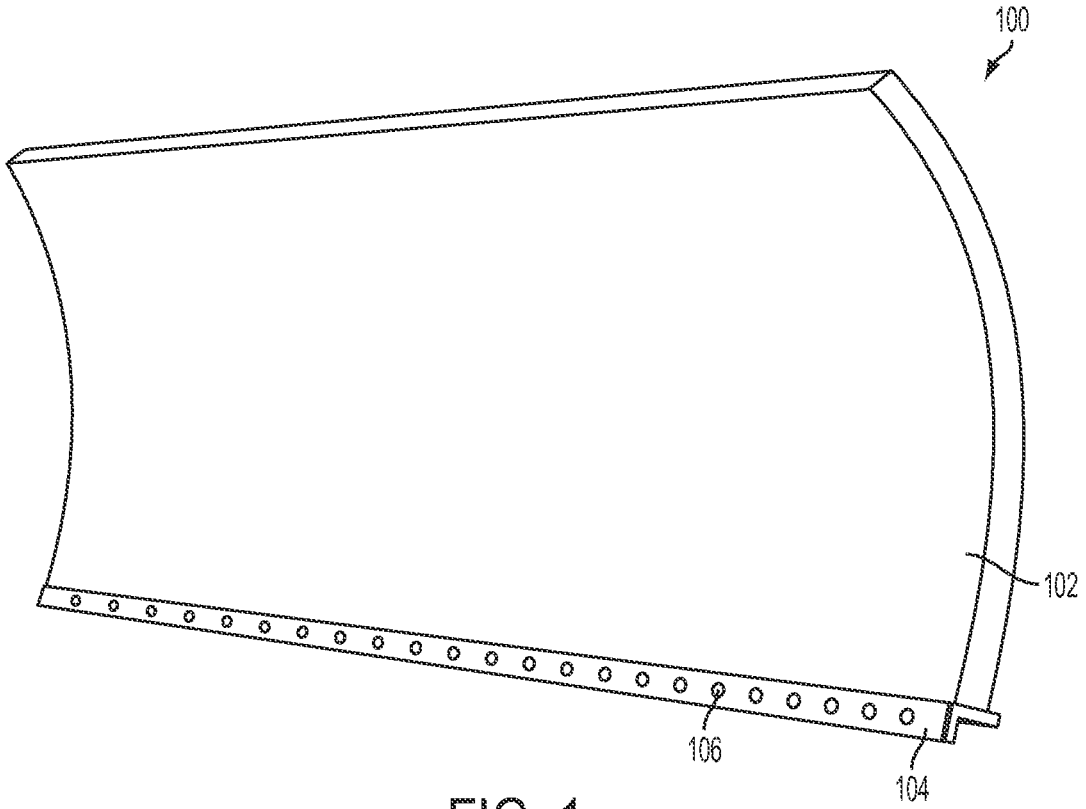
FIG. 1 is a perspective view of an exemplary plow moldboard.

FIG. 1 illustrates an exemplary moldboard 100 of a plow. As shown, the moldboard 100 includes a curved, concave portion 102 for directing snow or other material up and away from the roadway. A lower portion of the moldboard 100 includes spaced apertures 106 for attachment of a plow blade to the moldboard 100. As shown, the spaced apertures 106 are disposed in a separate member 104 attached to a lower edge of the curved portion 102. However, in other embodiments, the curved portion of the moldboard may itself include spaced apertures integral with the moldboard for attachment of the snow plow blade (see, e.g., FIGS. 2A and 2B).

The plow blade is often attached directly to the moldboard 100 of the plow. As such, the noise, shock, and vibrations generated when the plow blade edge scrapes against the roadway reverberate through the moldboard 100 and the plowing vehicle and are experienced by the operator of the vehicle. As a result, the operator of the vehicle may be exposed to potentially harmful levels of noise (e.g., above 90 dB) over significant periods of time.

When installed, the damping member of the present application reduces the amount of noise, shock, and vibration that is transmitted from the plow blade to the moldboard and plowing vehicle. For example, in one embodiment, the plow blade edge is coupled to a damping member that is positioned between the plow blade edge and the moldboard to isolate the surface of the plow blade edge from the moldboard and thereby from the plowing vehicle. As such, the damping member at least partially absorbs the noise, shock, and vibration from the plow blade edge. As a result, the amount of noise, shock, and vibration experienced by the operator of the vehicle is reduced when the damping member is used to mount a plow blade edge to the moldboard.

The damping member of the present application also reduces the shock and vibration experienced by the plow blade edge. For example, in one embodiment, the plow blade edge is coupled to a damping member that is positioned between the plow blade edge and the moldboard. Further, at least a portion of the damping member surrounds the fasteners attaching the plow blade edge to the moldboard. As discussed in more detail below, various designs are contemplated by which the damping member can surround the fasteners, including integral projections and separate inserts, sleeves, bushings or isolators. The damping member acts as a vibration isolator to reduce the shock and vibrations experienced by the plow blade edge. Further, in some embodiments, the damping member may be formed of a flexible or semi-rigid material to permit a certain amount of movement of the plow blade edge relative to the moldboard. As a result, the damping member reduces or suppresses the forces experienced by the plow blade edge, thereby reducing the wear and damage to the plow blade edge and increasing its useful life.

The damping member of the present application is intended to be universal in that it may be configured for use with any (or most) plowing systems and/or plow blade edge configurations. For example, the damping member may be used with front plows, underbody plows, wing plows, or tow plows. Exemplary front plow configurations include bottom trip, trip plow, one-way, section trip, slide trip, V-plow, or folding V-plow configurations ranging from 8 to 14 feet in blade length. Exemplary underbody plow configurations include high speed hinged, folding moldboard, fixed, or reversible configurations ranging from 9 to 13 feet in blade length. Exemplary wing plow configurations include patrol wing, benching leveling wing, mid mount wing, front mount wing, extendable mid mount wing, or rear mount wing configurations ranging from 6 to 13 feet in blade length. The damping member may also be used with a variety of tow plow configurations ranging from 5 to 32 feet in blade length.

The damping member of the present application may also be used with a variety of plow blade edges or plow blade edge configurations. For example, the damping member may be used with steel plow blade edges, such as square edge or top bevel, having various widths (e.g., ⅝", ¾", or 1") and various lengths (e.g., 5", 6", or 8"). Further, the damping member may be used with carbide plow blade edges, such as square edge or top bevel, having various configurations, including 8" double carbide center punch and top punch, carbide with welded cover, carbide with carbide matrix, or carbide with carbide overlay.

The damping member of the present application may also be used with plow blade edges having a variety of punch configurations, including top punch (e.g., 1.5" and 2" gauge) and center punch (e.g., 4" gauge) configurations. The damping member may be configured to fit a variety of punch layouts, including 3"-3"-12", 2"-8"-8", 4"-8"-8", or any other layout to fit any plow configuration. Further still, the damping member of the present application may be used with a variety of carbide configurations, including ⅝" or ¾" 25 degree trap, ¾" 40 degree trap, ⅝" or ¾" or 1" bull nose, ⅞" or 1" rooftop, or ¾" rectangular carbide configurations.

Figure 2A:
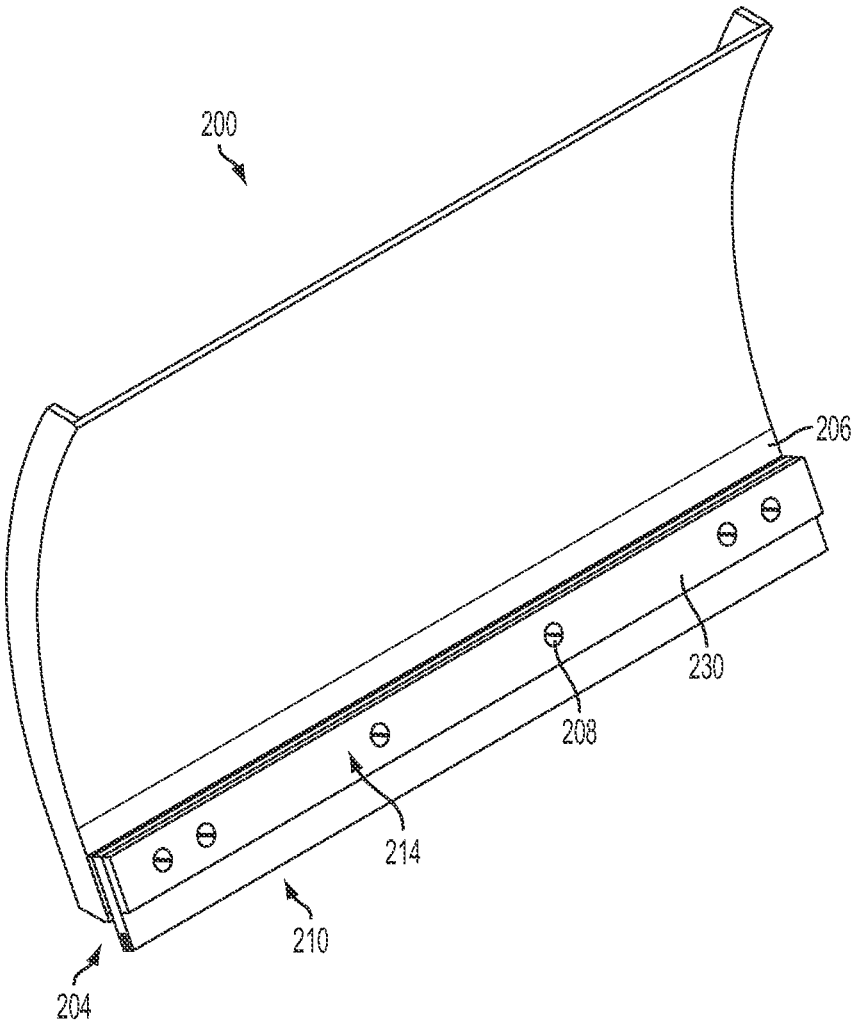
FIG. 2A is a perspective view of a plow blade according to an embodiment of the present application, wherein the plow blade is shown mounted to an exemplary plow moldboard.
Figure 2B:
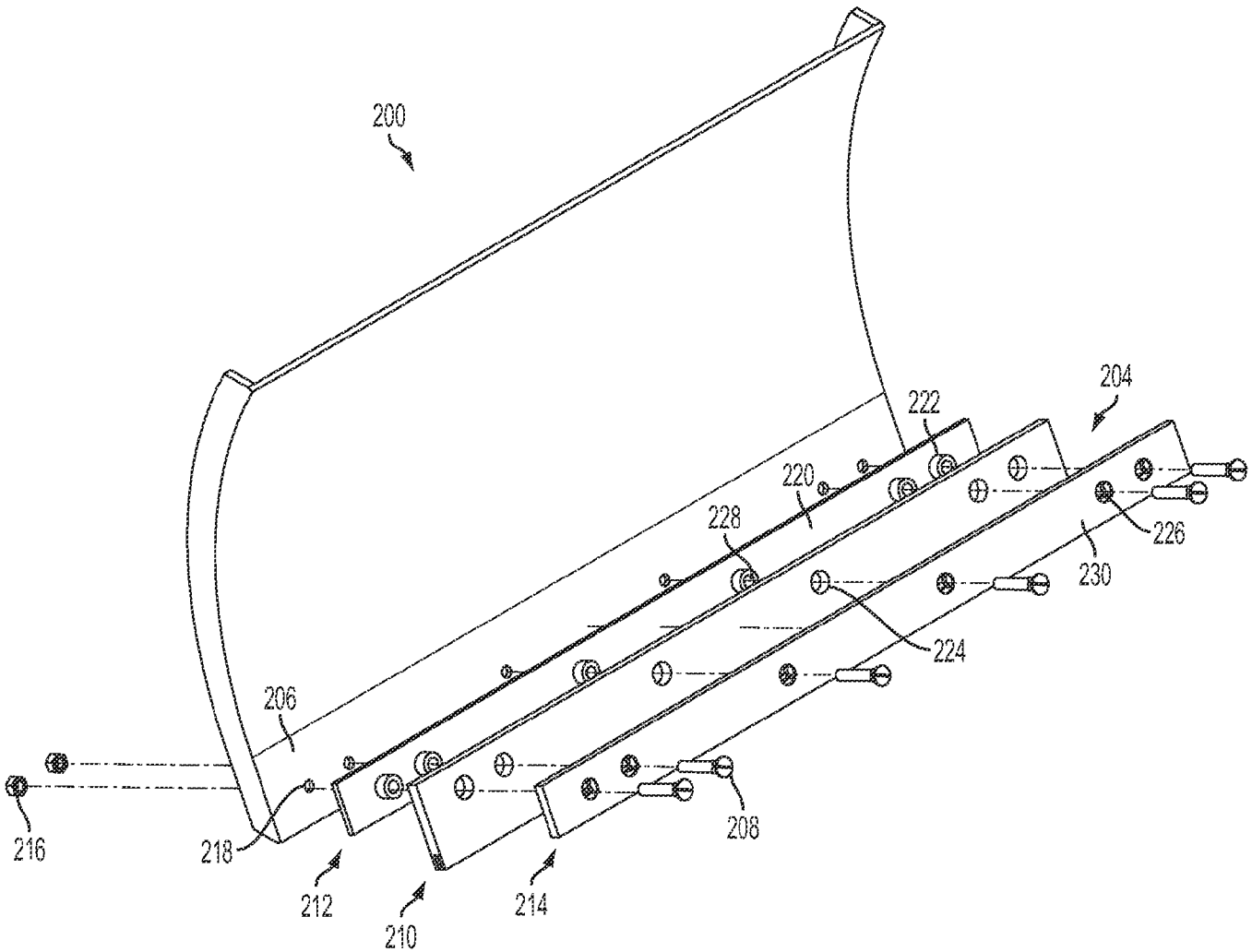
FIG. 2B is an exploded perspective view of the plow blade of FIG. 2A.

FIGS. 2A and 2B illustrate an exemplary plow 200 comprising a moldboard 206 and a plow blade 204 according to an embodiment of the present application. As shown, the plow blade 204 comprises a plow blade edge 210, a damping member 212, a mounting member 214, and a plurality of fasteners 208 for removable attachment of the plow blade to the moldboard 206 of the plow 200. The layout of the spaced apertures 218 in the moldboard 206 and the spaced apertures 224 in the plow blade edge 210 (i.e., punch layout) shown in the Figures is commonly referred to as a 3"-3"-12" layout. However, it should be noted that the moldboard 206 and plow blade edge 210 configurations shown in FIGS. 2A and 2B are merely exemplary and the damping member 212 may be configured for use with any plow system or plow blade edge configuration, including those mentioned in the paragraphs above. In other words, the damping member may contain apertures spaced in various layouts.

As illustrated in FIG. 2B, the damping member 212 comprises an elongate member 220 and a plurality of spaced bosses or projections 222 extending outward from a longitudinal surface of the elongate member. The spaced projections 222 are configured so that they are capable of being received in the spaced apertures 224 of the plow blade edge 210. As discussed in more detail later, the spaced projections may take various forms and in certain embodiments are absent. When the plow blade 204 is mounted to the moldboard 206, the damping member 212 is positioned between the plow blade edge 210 and the moldboard such that no portion of the surface of the plow blade edge contacts the moldboard.

As illustrated in FIG. 2B, the damping member 212 comprises spaced apertures 228 extending through each projection 222 and the elongate member 220 of the damping member. As shown, the interior surfaces of the spaced apertures 228 extending through the projections 222 are substantially smooth. However, in certain embodiments, the interior surface of one or more of the spaced apertures 228 may included one or more raised surfaces and/or may be at least partially threaded. Further, the mounting member 214 comprises spaced apertures 226 extending through an elongate member 230 of the mounting member. When the plow blade 204 is mounted to the moldboard 206, the fasteners 208 are inserted through the spaced apertures 226 in the mounting member 214, the spaced apertures 228 in the damping member 212, and the spaced apertures 218 in the moldboard to attach the plow blade to the moldboard. As such, no portion of the surface of the plow blade edge 210 contacts the fasteners 208 of the plow blade 204 when the plow blade is mounted to the moldboard 206.

As shown in FIG. 2B, threaded bolts (e.g., carriage bolts) and nuts are used to fasten the plow blade 204 to the moldboard 206. However, a variety of other suitable fasteners may be used, such as for example, pins, studs, posts, or the like. For example, in one embodiment, the mounting member 214 comprises posts or studs (e.g., threaded posts or studs) extending from a longitudinal surface of the elongate member 230. In this embodiment, it is contemplated that one end of the posts or studs may be welded or otherwise affixed to the mounting member. The projecting end of the posts or studs is inserted through the spaced apertures 228 in the damping member 212 and the spaced apertures 218 in the moldboard 206 to attach the plow blade 204 to the moldboard. A nut may be used with each post or stud to fasten the plow blade 204 to the moldboard 206.

As illustrated in FIGS. 2A and 2B, the mounting member 214 is formed from a single elongate member of strip-like shape 230 that facilitates fastening of the damping member 212 to the plow blade edge 210 and the moldboard 206. However, in other embodiments, the mounting member 214 is formed from a plurality of components configured to permit removal of the plow blade edge 210 from the damping member 212. For example, the mounting member 214 may comprise a plurality of plates (e.g., a washer) having one or more apertures. Each plate may be positioned between the head of one or more fasteners 208 and the plow blade edge 210. Further, each plate may be sized larger than the spaced aperture 224 in the plow blade edge 210 such that it fastens the damping member 212 to the plow blade edge and the moldboard 206.

As illustrated in FIG. 2B, the damping member 212 is formed from a single elongate member 220 positioned between the plow blade edge 210 and the moldboard 206. However, in other embodiments, the damping member 212 is formed from a plurality of components positioned between the plow blade edge 210 and the moldboard 206. For example, the damping member 212 may be divided into a plurality of segments (e.g., 10 or 12 inch segments) that are positioned end to end along the length of the plow blade edge 210. These segments may be sized to the length of the individual plow blade edges 210. Further, gaps may exist between two or more damping member segments such that the damping member 212 is not contiguous. However, even if the damping member is not contiguous it is still contemplated that the multiple damping member segments will function to prevent contact between the plow blade edge and the moldboard. Further still, two or more of the damping member segments may be removably attached together, such as for example, with a tongue/groove connection, male/female connection, straps, buckles, pins, screws, bolts, Velcro®, or other fastener. Further, one or more damping member segments may comprise male and/or female parts to facilitate proper alignment of the damping member with the plow blade edge, apertures, and/or fasteners.

In some embodiments, the damping member 212 does not include the spaced projections 222 extending from a longitudinal surface of the elongate member 220. In these embodiments, the elongate member 220 is positioned between the plow blade edge 210 and the moldboard 206 and no portion of the damping member 212 is inserted into the spaced apertures 224 of the plow blade edge. Furthermore, in these embodiments, when the plow blade 204 is mounted to the moldboard 206, the fasteners 208 are inserted through the spaced apertures 226 in the mounting member 214, the spaced apertures 224 in the plow blade edge 210, the spaced apertures 228 in the damping member 212, and the spaced apertures 218 in the moldboard 206 to attach the plow blade to the moldboard. The damping member 212 of the present application may also include less projections 222 than apertures 224 in the plow blade edge 210 such that one or more of the apertures in the plow blade edge do not receive a projection.

When projections are present in the damping member, the length of the projections may vary. For example, the length of the projections (by length is meant the distance by which they project beyond the surface of the damping member) may range between about ⅜" and about 1" or more. In certain embodiments, the projections have a length of about ⅜", about 5/16", about ½", about ¾", about 1", about half the thickness of the plow blade edge, about the thickness of the plow blade edge, at least the thickness of the plow blade edge, or greater than the thickness of the plow blade edge. Further, the thickness of the projections 222 may vary widely depending on the size of the apertures 224 in the plow blade edge 210 and/or the size of the fasteners 208. For example, in certain embodiments, the outside diameter of the projections 222 is about 1¼" and the inside diameter of the projections is about 11/16". Thus, the wall thickness of the projections 222 in these embodiments is about 9/32". Other wall thicknesses for the projections 222 are possible in other embodiments.

In some embodiments, the projections 222 of the damping member 212 may be separate components from the elongate member 220 of the damping member. The separate projections may or may not be attached to the elongate member 220. For example, one or more separate inserts, sleeves, bushings, or isolators may be received in the spaced apertures 224 of the plow blade edge 210 and surround the fastener 208 when the plow blade 204 is attached to the moldboard 206. These separate components may be made of the same material as the damping member 212 to provide the same or similar amount of noise, shock, and vibration reductions as the projections 222. In other embodiments, the separate components are made of a different material as the dampening member. In still further embodiments, one or more of the spaced apertures 224 may contain more than one separate insert, sleeve, bushing or isolators and each of these may be made of the same or of different materials.

The outer surface of the projections of the damping member may be a variety of shapes and sizes. For example, as illustrated in FIG. 2B, the outer surface of the projections 222 is circular in shape and configured to be received in the circular spaced apertures 224 of the plow blade edge 210. However, in certain embodiments, the outer surface of one or more of the projections 222 may be square, rectangular, oval, hexagonal, triangular, or any other shape. Further, the apertures 224 of the plow blade edge 210 may also be a variety of other shapes to correspond to the projections 222.

The damping member of the present application may be formed from a variety of materials capable of reducing or suppressing the noise, shock, and/or vibrations of the plow blade. The damping member may also be formed from a strong, durable material capable of supporting the plow blade edge and able to withstand the forces applied to the damping member by the plow blade edge.

The damping member of the present application may be made of a variety of materials, including metallic materials such as aluminum or non-metallic materials such as rubber, plastic, or polyurethane, that do not corrode in the presence of salt and water and are compatible with steel. Further, the properties of the damping member material and the thickness of the damping member may vary between embodiments and/or be tuned to a specific plow, moldboard, or plow blade edge. For example, the hardness, stiffness, thickness, and/or density of the damping member may vary based on the size, type, and/or configuration of the plow, moldboard, or plow blade edge. Further, the thickness of the damping member may range between about ⅜" and about 1" or more. In certain embodiments, the thickness of the damping member may be about ⅜", about ½", about ¾", about 1", or more.

The material of the damping member may be rigid, semi-rigid, or flexible. For example, in one embodiment, the material of the damping member is flexible or semi-rigid such that a 12" length of the damping member may be flexed by hand with minimal force. A flexible or semi-rigid damping member facilitates installation of the damping member and permits slight movement of the plow blade edge relative to the moldboard. However, in another embodiment, the material of the damping member is non-flexible or rigid such that a 12" length of the damping member may not be easily flexed by hand without application of substantial force. A non-flexible or rigid damping member provides greater support to the plow blade edge. Further, in some embodiments, the material of the damping member may be compressible and/or resilient.

As illustrated in FIGS. 2A and 2B, the damping member 212 comprises polyurethane having a hardness between about 65 and 95 Durometer A and a density between about 500 and 1500 kg/m$^3$. In one particular embodiment, the damping member 212 comprises polyurethane having a hardness of about 75 Durometer A and a density of about 1220 kg/m$^3$. Further, the damping member 212 is flexible or semi-rigid. However, as discussed above, the polyurethane material of the damping member 212 may have an increased hardness (e.g., a hardness between about 55 and 75 Durometer D) and be non-flexible or rigid to provide greater support to the plow blade edge 210.

In certain embodiments, the damping member 212 comprises rubber having a hardness between about 50 and 90 Durometer A and a density between about 500 and 1500 kg/m$^3$. In one particular embodiment, the damping member 212 comprises a rubber compound having a hardness of about 67 Durometer A and a density of about 1160 kg/m$^3$. Further, the damping member 212 is flexible or semi-rigid. [

The damping member of the present application may also comprise one or more materials joined or otherwise secured together to form the damping member. For example, one or more portions of the damping member may comprise a first material that is different than a second material found in one or more other portions of the damping member. The type, hardness, stiffness, thickness, and/or density of the first material may be different than the second material. Different types of materials include, for example, non-metallic and metallic materials, steel and polyurethane, rubber and plastic, rubber and polyurethane, etc. As an example, in one embodiment, at least a portion of the projections are made of a softer polyurethane than the elongate member of the damping member. In another embodiment, the outer surface of the projections are made of a softer polyurethane than the inner surface of the apertures extending through the projections. In yet another embodiment, the area around which the projections extend from the elongate member is made of a harder polyurethane than the projections to increase strength of the connection point.

The damping member of the present application may include one or more non-smooth surfaces. For example, surface features may be integrally molded or secured to one or more longitudinal surfaces of the damping member. These surface features may comprise grooves, notches, protrusions, ridges, bumps, or the like. These surface features may also create a pattern on the longitudinal surface of the damping member, such as a vertical, horizontal, curved, grid shaped, or interlocking pattern. In one embodiment, surface features are disposed on the longitudinal surface of the damping member contacting the plow blade edge to increase the friction and improve the adhesion between the damping member and the plow blade edge. Further, the surface features permit the damping member to adhere to the plow blade edge at various temperatures by allowing for the variation in expansion of the plow blade edge material (e.g., steel) and the damping member material (e.g., polyurethane).

Figure 3A:
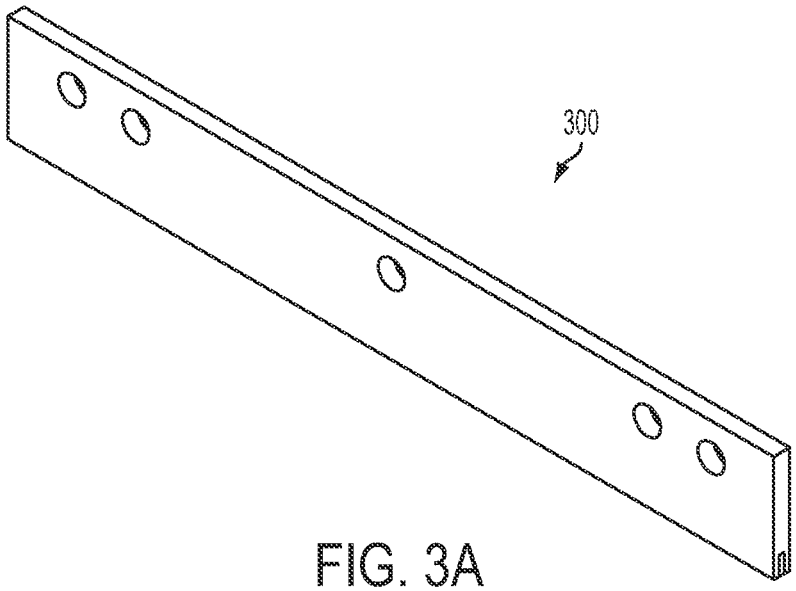
FIGS. 3A and 3B are perspective views of exemplary plow blade edges.
Figure 3B:
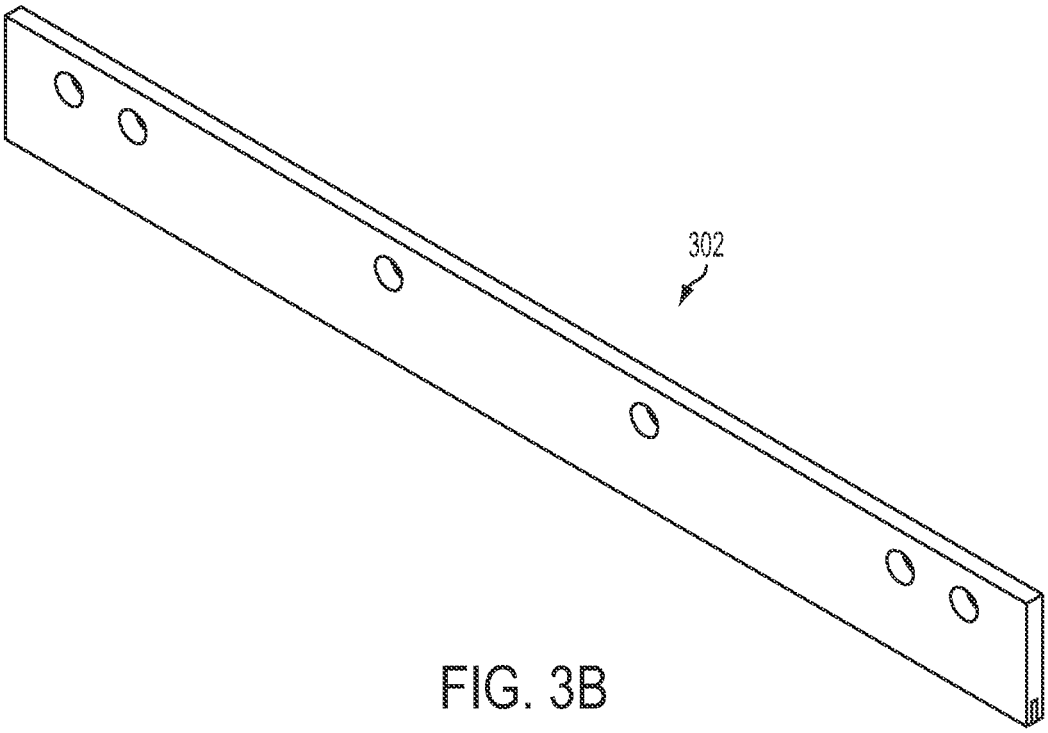
Figure 4A:
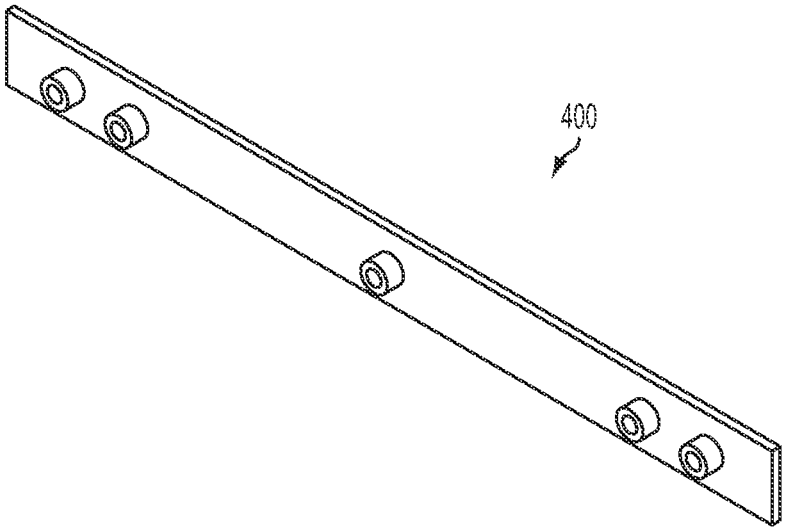
FIGS. 4A and 4B are perspective views of damping members according to embodiments of the present application.
Figure 4B:
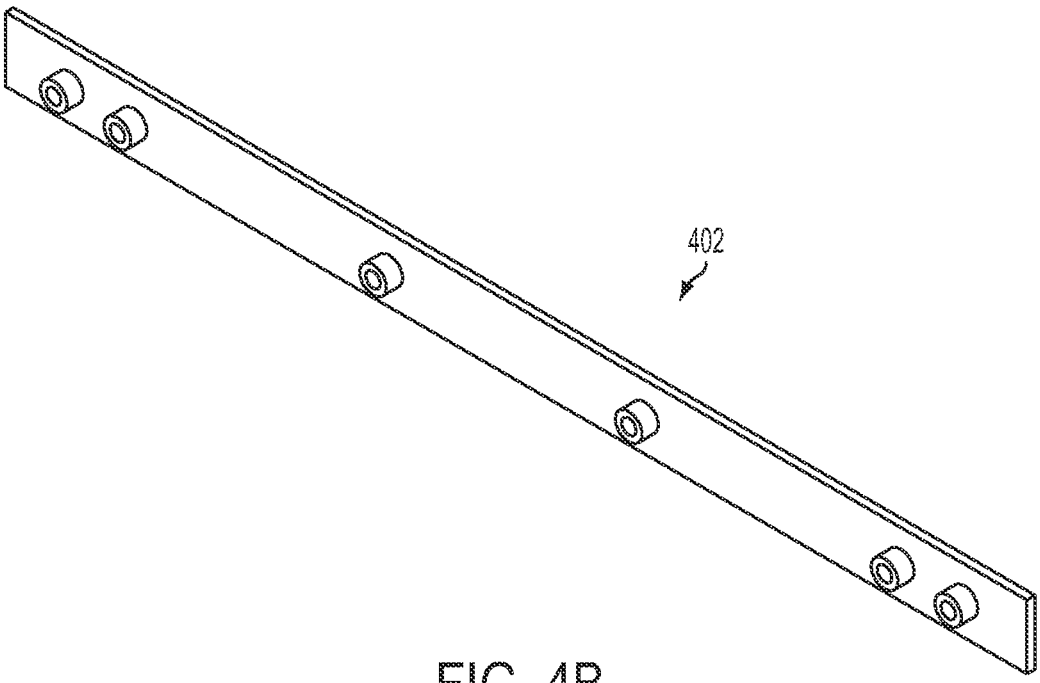
Figure 5A:
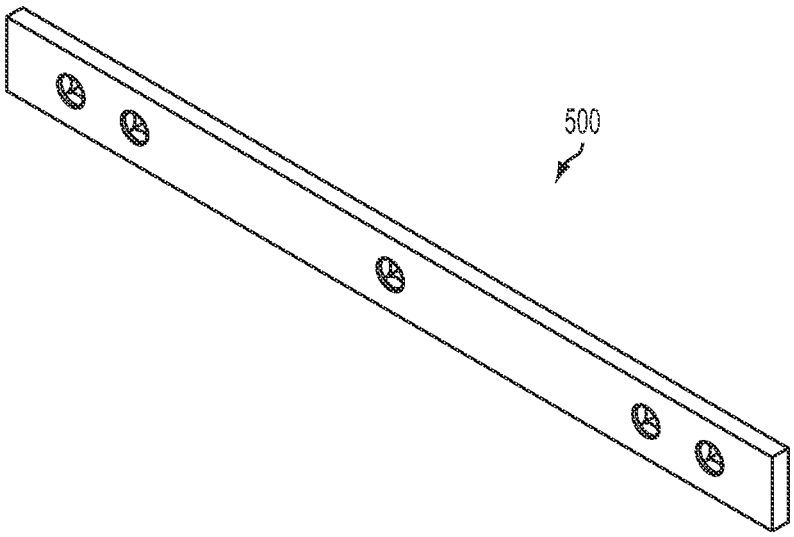
FIGS. 5A and 5B are perspective views of mounting members according to embodiments of the present application.
Figure 5B:
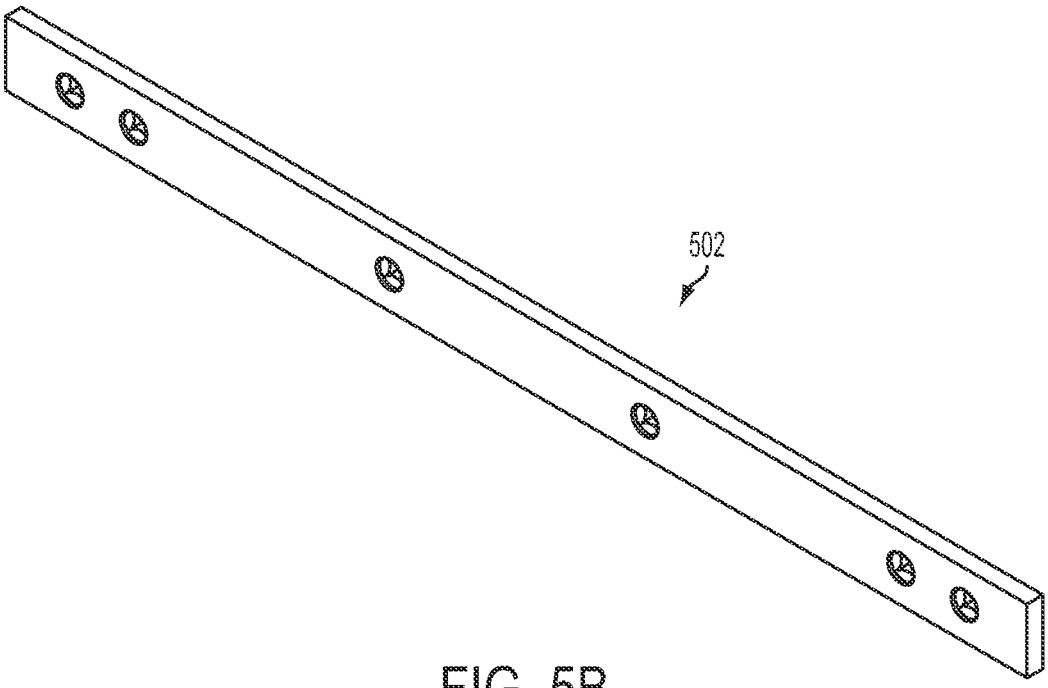

FIGS. 3A and 3B illustrate two exemplary plow blade edges 300 and 302 that may be used with the damping member of the present application. The plow blade edge 300 comprises a 3"-3"-12" hole layout and is about 36 inches long. The plow blade edge 302 also comprises a 3"-3"-12" hole layout and is about 48 inches long. FIGS. 4A and 4B illustrate two damping members 400 and 402 according to embodiments of the present application. The damping member 400 comprises a 3"-3"-12" hole layout and is about 36 inches long. The damping member 402 also comprises a 3"-3"-12" hole layout and is about 48 inches long. FIGS. 5A and 5B illustrate two mounting members 500 and 502 according to embodiments of the present application. The mounting member 500 comprises a 3"-3"-12" hole layout and is about 36 inches long. The mounting member 502 also comprises a 3"-3"-12" hole layout and is about 48 inches long.

Figure 6:
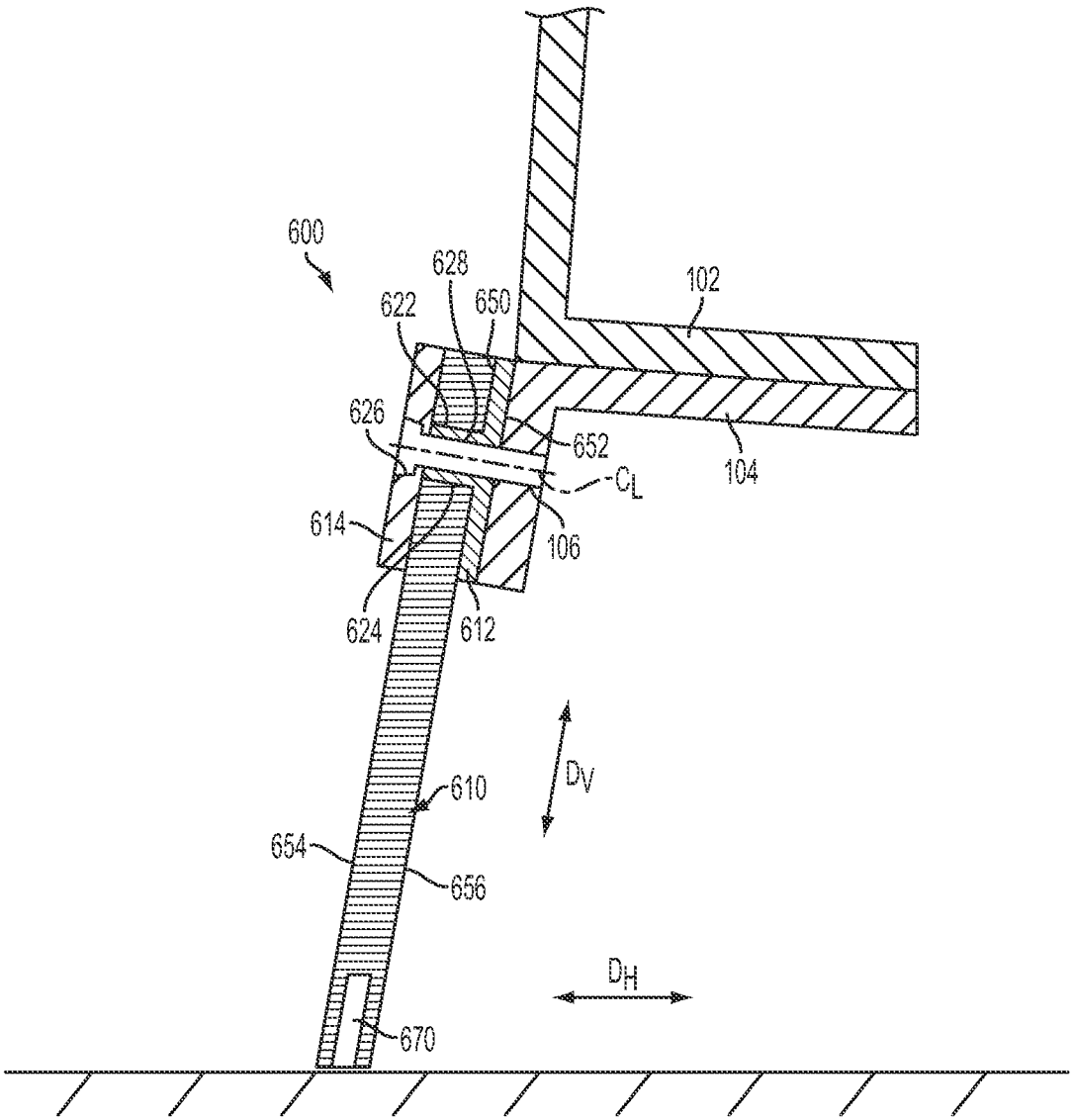
FIG. 6 is a cross sectional side view of a plow blade with a damping member according to an embodiment of the present application, wherein the plow blade is shown mounted to the exemplary plow moldboard shown in FIG. 1.

FIG. 6 is a cross sectional view of a plow blade 600 attached to the separate member 104 of the moldboard 100 illustrated in FIG. 1. As shown, the plow blade 600 comprises a plow blade edge 610 having a carbide metal insert 670, a damping member 612, and a mounting member 614. A fastener (not shown) is inserted through the axially aligned apertures in the mounting member 614, damping member 612, and moldboard 100 to attach the plow blade 600 to the moldboard.

As illustrated in FIG. 6, the damping member 612 is positioned between the plow blade edge 610 and the separate member 104 of the moldboard 100. A first longitudinal surface 650 of the damping member 612 is positioned adjacent to a second longitudinal surface 656 of the plow blade edge 610 and a second longitudinal surface 652 of the damping member is positioned adjacent the separate member 104 of the moldboard 100. As such, the damping member 612 insulates or isolates the plow blade edge 610 from the moldboard 100 of the plowing vehicle and at least partially absorbs the noise, shock, and vibration from the plow blade edge. As a result, the damping member 612 reduces the amount of noise, shock, and vibration experienced by the operator of the vehicle.

As discussed above, the first longitudinal surface 650 and/or the second longitudinal surface 652 of the damping member 612 may include a non-smooth surface or surface features that increase the friction and provide greater adhesion between the damping member and the adjacent component, e.g., the plow blade edge 610 or the separate member 104 of the moldboard 100.

As illustrated in FIG. 6, an aperture 624 extends through the plow blade edge 610 from a first longitudinal surface 654 to the second longitudinal surface 656 of the plow blade edge. The projection 622 of the damping member 612 is sized and shaped to be received in the aperture 624. As shown, the projection 622 extends through the aperture 624 and an end of the projection terminates at the first longitudinal surface 654 of the plow blade edge 610 and is flush therewith. However, in other embodiments, the projection 622 may extend beyond the first longitudinal surface 654 of the plow blade edge 610 or may extend only partially through the aperture 624.

As illustrated in FIG. 6, an aperture 628 extends through the damping member 612. The aperture 628 is axially aligned with and extends through the projection 622. As such, the projection 622 is configured to surround the fastener (not shown) used to mount the plow blade 600 to the moldboard 100. As a result, no portion of the plow blade edge 610 contacts the fastener of the plow blade 600 when the plow blade is mounted to the moldboard 100. In some embodiments, the projection 622 of the damping member 612 is configured to only partially surround the fastener used to mount the plow blade 610 to the moldboard 100.

The projection 622 of the damping member 612 acts as a vibration isolator to reduce the shock and vibrations experienced by the plow blade edge 610. Further, in some embodiments, the projection 622 of the damping member 612 may be formed of a flexible or semi-rigid material to permit a certain amount of movement of the plow blade edge 610 relative to the moldboard 100. For example, as illustrated in FIG. 6, the damping member 612 may permit some vertical movement of the plow blade edge 610 relative to the moldboard 100 in a direction $D_V$ and/or horizontal movement of the plow blade edge relative to the moldboard in a direction $D_H$. As a result, the damping member 612 reduces or suppresses the forces experienced by the plow blade edge 610, thereby reducing the wear and damage to the plow blade edge and increasing its useful life.

In some embodiments, the projection 622 of the damping member 612 comprises an insert, sleeve, or bushing positioned within the portion of the aperture 628 extending through the projection. The insert comprises an opening that is substantially aligned with the aperture 628 for receipt of the fastener. The insert is generally made of different material than the projection 622. For example, the material of the insert may be harder than the projection 622 to reduce the amount of wear or damage to the projection from the fastener. In one embodiment, the material of the insert is metallic (e.g., steel) and the projection 622 is made of polyurethane; however, a variety of other materials may be used.

In the embodiment illustrated in FIG. 6, when the plow blade 600 is mounted to the moldboard 100, the mounting member 614, plow blade edge 610, and damping member 612 are arranged such that there are no gaps or spaces between the adjacent components. As such, the components of the plow blade 600 form a robust mounting system for the plow blade edge 610 having the strength and rigidity to withstand the forces applied to the plow blade edge during plowing while reducing the amount of noise, shock, and vibration of the plow blade edge.

Figure 7:
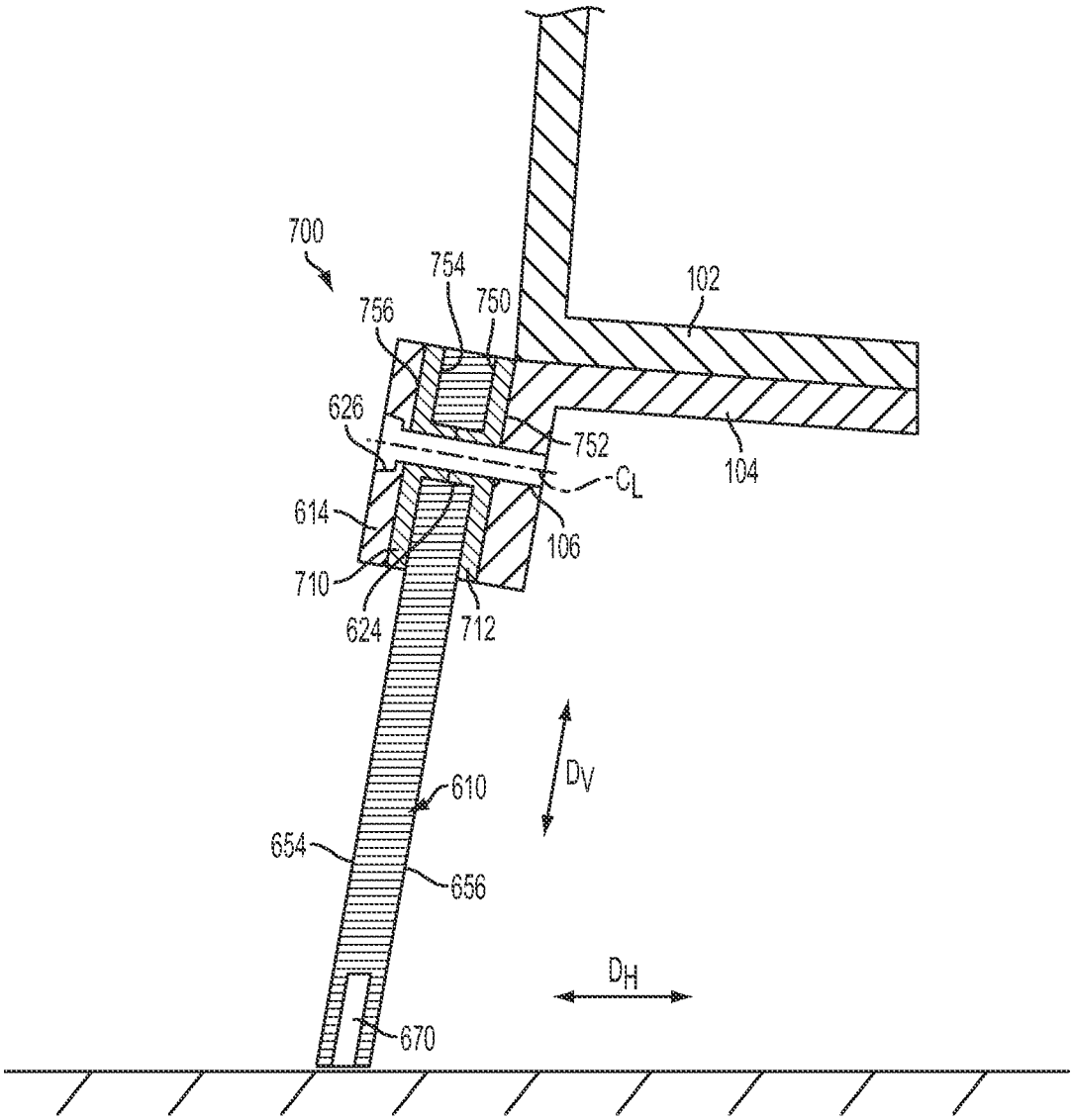
FIG. 7 is a cross sectional side view of a plow blade with a damping member according to an embodiment of the present application, wherein the plow blade is shown mounted to the exemplary plow moldboard shown in FIG. 1.

FIG. 7 is a cross sectional view of a plow blade 700 attached to the separate member 104 of the moldboard 100 illustrated in FIG. 1. As shown, the plow blade 700 comprises the plow blade edge 610 having the carbide metal insert 670, a first damping member 710, a second damping member 712, and the mounting member 614. A fastener (not shown) is inserted through the axially aligned apertures in the mounting member 614, damping members 710 and 712, and the moldboard 100 to attach the plow blade 700 to the moldboard.

It should be understood that the damping members 710 and 712 may be constructed of any of the materials described herein. One damping member 710 or 712 may be made of the same or different materials than the other damping member. Further, one portion of the damping member 710 or 712 may be made of a first material and other portions of the damping member may be made of a second material. For example, the projections of the damping member 710 or 712 may be made of a different material than the elongate member of the damping member.

As illustrated in FIG. 7, the first damping member 710 is positioned between the mounting member 614 and the plow blade edge 610. A first longitudinal surface 754 of the first damping member 710 is positioned adjacent to a first longitudinal surface 654 of the plow blade edge 610 and a second longitudinal surface 756 of the first damping member is positioned adjacent the mounting member 614. As such, the first damping member 710 insulates or isolates the plow blade edge 610 from the mounting member 614 and at least partially absorbs the noise, shock, and vibration from the plow blade edge.

Further, as illustrated in FIG. 7, the second damping member 712 is positioned between the plow blade edge 610 and the separate member 104 of the moldboard 100. A first longitudinal surface 750 of the second damping member 712 is positioned adjacent to a second longitudinal surface 656 of the plow blade edge 610 and a second longitudinal surface 752 of the second damping member is positioned adjacent the separate member 104 of the moldboard 100. As such, the first and second damping members 710 and 712 completely insulate or isolate the plow blade edge 610 from any contact with the mounting member 614 and the moldboard 100 of the plowing vehicle. As such, the first and second damping members 710 and 712 at least partially absorb the noise, shock, and vibration from the plow blade edge and reduce the amount of noise, shock, and vibration experienced by the operator of the vehicle.

As illustrated in FIG. 7, the projections of the first and second damping members 710 and 712 are sized and shaped to be received in the aperture 624 of the plow blade edge 610. The projection of each damping member 710 and 712 extends through the aperture 624 and an end of the projection terminates about half way through the aperture. However, in other embodiments, one damping member may include a projection that extends substantially all the way through the aperture 624 and is substantially flush with a longitudinal surface of the plow blade edge 610 such that the other damping member does not have a projection that extends through the aperture. Further, in certain embodiments, the projections of the first and second damping members 710 and 712 may extend more or less than half way through the aperture 624 of the plow blade edge 610.

In certain embodiments, the first and second damping members 710 and 712 may include one or more features that permit removable attachment of the damping members. For example, the projections may include features (e.g., on the end of the projection) that permit the projections to be removably attached within the aperture 624 of the plow blade edge 610. Further, a projection of one damping member that extends all the way through the aperture 624 may include one or more features configured to mate with a corresponding feature of the other damping member. Examples of features that permit removable attachment include, but are not limited to, a tongue/groove connection, male/female connection, pins, threaded fasteners, Velcro®, adhesive, or other fasteners.

Further, as illustrated in FIG. 7, the projections of the first and second damping members 710 and 712 are configured to surround the fastener (not shown) used to mount the plow blade 700 to the moldboard 100. As a result, no portion of the plow blade edge 610 contacts the fastener of the plow blade 700 when the plow blade is mounted to the moldboard 100. Thus, there is no metal-to-metal contact between the plow blade edge 610 and any component of the plow blade 700 because the first and second damping members 710 and 712 completely isolate the plow blade edge from any direct contact with the fastener, mounting member 614, or the moldboard 100. In some embodiments, the projections of the first and second damping members 710 and 712 are configured to only partially surround the fastener used to mount the plow blade edge 610 to the moldboard 100.

The projections of the first and second damping members 710 and 712 act as vibration isolators to reduce the shock and vibrations experienced by the plow blade edge 610. Further, in some embodiments, the projections may be formed of a flexible or semi-rigid material to permit a certain amount of movement of the plow blade edge 610 relative to the moldboard 100. For example, as illustrated in FIG. 7, the damping members 710 and 712 may permit vertical movement of the plow blade edge 610 relative to the moldboard 100 in a direction $D_V$ and/or horizontal movement of the plow blade edge relative to the moldboard in a direction $D_H$. As a result, the damping members 710 and 712 reduce or suppress the forces experienced by the plow blade edge 610, thereby reducing the wear and damage to the plow blade edge and increasing its useful life.

In the embodiment illustrated in FIG. 7, when the plow blade 700 is mounted to the moldboard 100, the mounting member 614, plow blade edge 610, and damping members 710 and 712 are arranged such that there are no gaps or spaces between the adjacent components. As such, the components of the plow blade 700 form a robust mounting system for the plow blade edge 610 having the strength and rigidity to withstand the forces applied to the plow blade edge during plowing while reducing the amount of noise, shock, and vibration of the plow blade edge.

One exemplary method of installing a plow blade of the present application to a moldboard is described below with reference to the plow blade shown in FIG. 6. However, it should be understood, that the method may be used, in whole or in part, to install any plow blade of the present application.

One exemplary method of installing the plow blade 600 comprises aligning the projection 622 extending from the first longitudinal surface 650 of the damping member 612 with the aperture 624 in the plow blade edge 610. The projection 622 is inserted into the aperture 624 in the plow blade edge 610 and the first longitudinal surface 650 of the damping member 612 is positioned against the second longitudinal surface 656 of the plow blade edge. In some embodiments, however, the damping member 612 may not include any projections 622 extending from the first longitudinal surface 650 of the damping member. In these embodiments, the aperture 628 in the damping member 612 is aligned with the aperture 624 in the plow blade edge 610 and the first longitudinal surface 650 of the damping member is positioned against the second longitudinal surface 656 of the plow blade edge.

Further, the aperture 628 of the damping member 612 is aligned with the aperture 626 in the mounting member 614. A longitudinal surface of the mounting member 614 is positioned against the first longitudinal surface 654 of the plow blade edge 610 such that the plow blade edge is between the mounting member and the damping member 612. In some embodiments, however, the fastener is fixed to the mounting member 614 and the longitudinal surface of the mounting member is automatically positioned against the first longitudinal surface 654 of the plow blade edge 610 when the fastener is inserted into the aperture 628 of the damping member 612 such that the plow blade edge is between the mounting member and the damping member.

Further, the aperture 628 in the damping member 612 is aligned with the aperture 106 in the moldboard 100 and the second longitudinal surface 652 of the damping member is positioned against the moldboard. The fastener (not shown in FIG. 6) is inserted through the aperture 626 in the mounting member 614, the aperture 628 in the damping member 612, and the aperture 106 in the moldboard 100 to mount the plow blade 600 to the moldboard.

Another exemplary method of installing a plow blade of the present application to a moldboard is described below with reference to the plow blade shown in FIG. 7. However, it should be understood, that the method may be used, in whole or in part, to install any plow blade of the present application.

One exemplary method of installing the plow blade 700 comprises aligning the projections of the damping members 710 and 712 with the aperture 624 in the plow blade edge 610. The projections are inserted into the aperture 624 in the plow blade edge 610 and the first longitudinal surface 754 of the first damping member 710 is positioned adjacent to the first longitudinal surface 654 of the plow blade edge 610 and the first longitudinal surface 750 of the second damping member 712 is positioned adjacent to the second longitudinal surface 656 of the plow blade edge 610. In some embodiments, however, one or more of the damping members 710 and 712 may not include any projections extending from the damping member. In these embodiments, the aperture in the damping member is aligned with the aperture 624 in the plow blade edge 610 and the damping member is positioned against the longitudinal surface of the plow blade edge.

Further, the aperture of the first damping member 710 is aligned with the aperture 626 in the mounting member 614. The longitudinal surface of the mounting member 614 is positioned against the second longitudinal surface 756 of the first damping member 710 such that the first damping member is between the mounting member and the plow blade edge 610. In some embodiments, however, the fastener is fixed to the mounting member 614 and the longitudinal surface of the mounting member is automatically positioned against the second longitudinal surface 756 of the first damping member 710 when the fastener is inserted into the aperture of the first damping member.

Further, the aperture of the second damping member 712 is aligned with the aperture 106 in the moldboard 100 and the second longitudinal surface 752 of the second damping member is positioned against the moldboard. The fastener (not shown in FIG. 7) is inserted through the aperture 626 in the mounting member 614, the apertures in the damping members 710 and 712, and the aperture 106 in the moldboard 100 to mount the plow blade 700 to the moldboard.

As described herein, when one or more components are described as being connected, joined, affixed, coupled, attached, or otherwise interconnected, such interconnection may be direct as between the components or may be in direct such as through the use of one or more intermediary components. Also as described herein, reference to a "member," "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasably or removably connected or attached together, any type of releasable connection may be suitable including for example, locking connections, fastened connections, tongue and groove connections, etc. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A plow blade for mounting to a plow moldboard, the plow blade comprising:

a plow blade edge having at least one aperture extending therethrough for mounting the plow blade to the lower portion of the moldboard, wherein the plow blade edge comprises a wear surface that contacts the roadway when the plow blade is in use;

a non-metallic damping member positioned between the plow blade edge and the moldboard such that no portion of the plow blade edge contacts the moldboard when the plow blade is mounted to the moldboard and the wear surface of the plow blade edge contacting the roadway is isolated from the moldboard, wherein:

no portion of the damping member contacts the roadway when the plow blade is in use, the damping member has at least one aperture extending therethrough that is substantially aligned with the at least one aperture of the plow blade edge when the plow blade is mounted to the moldboard, the damping member is positioned between the plow blade edge and the moldboard such that no portion of the plow blade having a surface that contacts the roadway when the plow blade is in use contacts the moldboard, the damping member is a piece of non-metallic material comprising at least one projection surrounding the at least one aperture of the damping member and extending from a longitudinal surface of the damping member, the at least one aperture of the damping member extends through the at least one projection, and the at least one projection is at least partially received in the at least one aperture of the plow blade edge when the plow blade is mounted to the moldboard; and at least one fastener extending through the at least one aperture of the plow blade edge and the at least one aperture of the damping member to mount the plow blade to the moldboard, wherein no portion of the plow blade edge contacts the at least one fastener;

wherein the damping member is configured to be mounted directly to the lower portion of the moldboard without an additional plate positioned between the damping member and the moldboard to mount the damping member to the moldboard.

2. The plow blade of claim 1, wherein the at least one projection extends through the at least one aperture of the plow blade edge.

3. The plow blade of claim 2, wherein the at least one projection comprises a metallic insert having an aperture and centered within the at least one aperture of the damping member.

4. The plow blade of claim 1 further comprising a mounting member, wherein the plow blade edge is positioned between the damping member and the mounting member when the plow blade is mounted to the moldboard.

5. The plow blade of claim 4, wherein the mounting member comprises at least one aperture that is substantially aligned with the at least one aperture of the plow blade edge and the at least one aperture of the damping member when the plow blade is mounted to the moldboard, and wherein the at least one fastener extends through the at least one aperture of the mounting member to fasten the plow blade to the moldboard.

6. The plow blade of claim 4, wherein the at least one fastener is fixed to the mounting member and extends through the at least one aperture of the plow blade edge and the at least one aperture of the damping member to mount the plow blade to the moldboard.

7. The plow blade of claim 1, wherein the plow blade edge and the lower portion of the moldboard each comprise a plurality of spaced apertures extending therethrough, and wherein the damping member comprises a plurality of spaced projections extending from a longitudinal surface of the damping member, each projection comprising an aperture extending therethrough such that when the damping member and the plow blade edge are mounted to the moldboard the spaced apertures of the plow blade edge and the lower portion of the moldboard align with the apertures of the damping member.

8. The plow blade of claim 7, wherein each projection of the damping member extends through a spaced aperture of the plow blade edge when the plow blade is mounted to the moldboard.

9. The plow blade of claim 8 further comprising a mounting member having a plurality of spaced apertures, wherein the plow blade edge is positioned between the damping member and the mounting member when the plow blade is mounted to the moldboard, and wherein each spaced aperture of the mounting member is substantially aligned with an aperture of each projection of the damping member when the plow blade is mounted to the moldboard.

10. The plow blade of claim 9 further comprising a plurality of fasteners, each fastener extending through a spaced aperture of the mounting member and an aperture of a projection to mount to the plow blade to the moldboard.

11. The plow blade of claim 1, wherein the damping member comprises a non-corrosive material.

12. The plow blade of claim 1, wherein the damping member comprises a unitary piece of polyurethane.

13. The plow blade of claim 12, wherein the polyurethane has a hardness between about 65 and 95 Durometer A.

14. The plow blade of claim 12, wherein the polyurethane has a hardness between about 55 and 75 Durometer D.

15. The plow blade of claim 12, wherein the polyurethane has a density between about 500 and 1500 kg/m$^3$.

16. The plow blade of claim 12, wherein the damping member is non-flexible.

17. The plow blade of claim 12, wherein the at least one projection comprises a metallic bushing having an aperture and centered within the at least one aperture of the damping member.

18. The plow blade of claim 12 further comprising a mounting member, wherein the plow blade edge is positioned between the damping member and the mounting member when the plow blade is mounted to the moldboard.

19. The plow blade of claim 1, wherein the damping member comprises a first material and a second material, and wherein at least one of the type, hardness, stiffness, thickness, and density of the first material is different than the second material.

20. The plow blade of claim 19, wherein the first material and the second material comprise polyurethane, and wherein the hardness of the first material is greater than the hardness of the second material.

21. The plow blade of claim 1, wherein at least one longitudinal surface of the damping member comprises a non-smooth outer surface.

22. The plow blade of claim 21, wherein the at least one longitudinal surface comprises one or more surface features selected from the group consisting of grooves, notches, protrusions, ridges, and bumps.

23. The plow blade of claim 1, wherein the wear surface of the plow blade edge is the only surface of the plow blade that contacts the roadway when the plow blade is in use.

24. The plow blade of claim 23, wherein the plow blade edge comprises a carbide metal insert, and wherein the wear surface of the plow blade edge includes a surface of the carbide metal insert contacting the roadway when the plow blade is in use.

25. The plow blade of claim 1, wherein:

the plow blade edge and the lower portion of the moldboard each comprise a plurality of spaced apertures extending therethrough;

the damping member comprises a plurality of spaced projections extending from a longitudinal surface of the damping member, each projection comprising an aperture extending therethrough such that when the damping member and the plow blade edge are mounted to the moldboard the spaced apertures of the plow blade edge and the lower portion of the moldboard align with the apertures of the damping member; and the lower portion of the moldboard, damping member, and plow blade edge have the same layout of spaced apertures, and wherein the layout of spaced apertures permits a variety of plow blade edges to be mounted with the damping member to the lower portion of the moldboard without an additional plate positioned between the damping member and the moldboard.

26. A plow blade for mounting to a plow moldboard, the plow blade comprising:

a plow blade edge having at least one aperture extending therethrough for mounting the plow blade to the moldboard, wherein the plow blade edge comprises a wear surface that contacts the roadway when the plow blade is in use;

a mounting member for mounting the plow blade to the moldboard, wherein the mounting member has at least one aperture extending therethrough that is substantially aligned with the at least one aperture of the plow blade edge when the plow blade is mounted to the moldboard;

a first non-metallic damping member positioned between the plow blade edge and the moldboard such that no portion of the plow blade edge contacts the moldboard when the plow blade is mounted to the moldboard and the wear surface of the plow blade edge contacting the roadway is isolated from the moldboard, wherein:

no portion of the first damping member contacts the roadway when the plow blade is in use, the first damping member has at least one aperture extending therethrough that is substantially aligned with the at least one aperture of the plow blade edge when the plow blade is mounted to the moldboard, the first damping member is positioned between the plow blade edge and the moldboard such that no portion of the plow blade having a surface that contacts the roadway when the plow blade is in use contacts the moldboard, the first damping member is a piece of non-metallic material comprising at least one projection surrounding the at least one aperture of the first damping member and extending from a longitudinal surface of the first damping member, the at least one aperture of the first damping member extends through the at least one projection, and the at least one projection is at least partially received in the at least one aperture of the plow blade edge when the plow blade is mounted to the moldboard; and a second non-metallic damping member positioned between the mounting member and the plow blade edge such that no portion of the plow blade edge contacts the mounting member when the plow blade is mounted to the moldboard, wherein no portion of the second damping member contacts the roadway when the plow blade is in use, and wherein the second damping member has at least one aperture extending therethrough that is substantially aligned with the at least one aperture of the plow blade edge when the plow blade is mounted to the moldboard; and at least one fastener extending through the at least one aperture of the mounting member, second damping member, plow blade edge, and first damping member to mount the plow blade to the moldboard, wherein no portion of the plow blade edge contacts the at least one fastener;

wherein the first damping member is capable of being mounted directly to the lower portion of the moldboard with no additional plate positioned between the first damping member and the moldboard to mount the first damping member to the moldboard.

27. The plow blade of claim 26, wherein the second damping member comprises at least one projection surrounding the at least one aperture of the second damping member and extending from a longitudinal surface of the second damping member, and wherein the at least one aperture of the second damping member extends through the at least one projection of the second damping member, and wherein the at least one projection of the second damping member is at least partially received in the at least one aperture of the plow blade edge when the plow blade is mounted to the moldboard.

28. A plow blade for mounting to a plow moldboard, the plow blade comprising a plow blade edge comprising a wear surface that contacts the roadway when the plow blade is in use;

a polyurethane damping member positioned between the plow blade edge and the moldboard such that no portion of the plow blade edge contacts the moldboard when the plow blade is mounted to the moldboard and the wear surface of the plow blade edge contacting the roadway is isolated from the moldboard, wherein:

no portion of the damping member contacts the roadway when the plow blade is in use, the damping member is positioned between the plow blade edge and the moldboard such that no portion of the plow blade having a surface that contacts the roadway when the plow blade is in use contacts the moldboard, the plow blade edge and the lower portion of the moldboard each comprise a plurality of spaced apertures extending therethrough, the damping member is a single piece of material and comprises a plurality of spaced projections extending from a longitudinal surface of the damping member, each projection comprising an aperture extending therethrough such that when the damping member and the plow blade edge are mounted to the moldboard the spaced apertures of the plow blade edge and the lower portion of the moldboard align with the apertures of the damping member, and each spaced projection of the damping member extends through a spaced aperture of the plow blade edge when the plow blade is mounted to the moldboard; and at least one fastener mounting the plow blade edge and the damping member to the moldboard, wherein no portion of the plow blade edge contacts the at least one fastener of the plow blade;

wherein the lower portion of the moldboard, damping member, and plow blade edge have the same layout of spaced apertures, and wherein the layout of spaced apertures permits a variety of plow blade edges to be mounted with the damping member to the lower portion of the moldboard without an additional plate positioned between the damping member and the moldboard.

29. The plow blade of claim 28, wherein the polyurethane has a hardness between about 65 and 95 Durometer A.

30. The plow blade of claim 28, wherein the polyurethane has a hardness between about 55 and 75 Durometer D.

31. The plow blade of claim 28, wherein the polyurethane has a density between about 500 and 1500 $kg/m^3$.

32. The plow blade of claim 28, wherein the damping member is non-flexible.

* * * * *